US011834854B2

(12) United States Patent
De Bondt et al.

(10) Patent No.: US 11,834,854 B2
(45) Date of Patent: Dec. 5, 2023

(54) TRANSPORT ANCHOR HAVING A FIBRE-PLASTIC COMPOSITE MATERIAL PRESSURE ELEMENT

(71) Applicant: ECONAC BVBA, Mechelen (BE)

(72) Inventors: Renzo De Bondt, Bonheiden (BE); Tom De Bondt, Bonheiden (BE)

(73) Assignee: ECONAC BVBA, Mechelen (BE)

( * ) Notice: Subject to any disclaimer, the term of this patent is extended or adjusted under 35 U.S.C. 154(b) by 138 days.

(21) Appl. No.: 17/426,475

(22) PCT Filed: Jan. 28, 2020

(86) PCT No.: PCT/EP2020/052001
§ 371 (c)(1),
(2) Date: Aug. 6, 2021

(87) PCT Pub. No.: WO2020/157041
PCT Pub. Date: Aug. 6, 2020

(65) Prior Publication Data

US 2021/0355696 A1 Nov. 18, 2021

(30) Foreign Application Priority Data

Jan. 28, 2019 (DE) ..... 10 2019 102 065.4

(51) Int. Cl.
*E04G 21/14* (2006.01)

(52) U.S. Cl.
CPC ..... *E04G 21/145* (2013.01)

(58) Field of Classification Search
CPC ... E04G 21/142; E04G 21/145; E04G 21/147; E04C 2002/002
See application file for complete search history.

(56) References Cited

FOREIGN PATENT DOCUMENTS

| | | | | |
|---|---|---|---|---|
| DE | 10038249 | A1 | | 4/2001 |
| DE | 102005009708 | A1 | | 9/2006 |
| DE | 102005009708 | A1 | * | 9/2006 |
| DE | 202011000293 | U1 | | 4/2011 |
| DE | 202014103774 | U1 | | 11/2015 |
| DE | 202014103774 | U1 | * | 12/2015 |
| DE | 102016119352 | A1 | | 4/2018 |
| DE | 102017102903 | A1 | * | 9/2018 |

(Continued)

OTHER PUBLICATIONS

Machine translation of DE202014103774U1, https://worldwide.espacenet.com/patent/search; Mar. 6, 2023 (Year: 2023).*

(Continued)

*Primary Examiner* — Ryan D Kwiecinski
(74) *Attorney, Agent, or Firm* — CANTOR COLBURN LLP

(57) ABSTRACT

A transport anchor for double walls, includes a bow-shaped basic body, having an arcuate central portion for suspending slinging components, two anchor legs which emanate from the central portion and extend substantially parallel to one another, and a pressure element which is arranged between the anchor legs. The pressure element is formed from a fibre-plastic composite material and has, at its two ends, end caps which are placed by their open side onto free ends of the cylindrical pressure element and which each have openings through each of which an anchor leg extends.

10 Claims, 4 Drawing Sheets

(56) References Cited

FOREIGN PATENT DOCUMENTS

| | | | | | |
|---|---|---|---|---|---|
| EP | 3029220 | A1 | | 6/2016 | |
| EP | 3029220 | A1 | * | 6/2016 | |
| EP | 3309327 | A1 | * | 4/2018 | |
| EP | 3309327 | A1 | | 4/2018 | |
| EP | 3640410 | B1 | * | 12/2021 | |
| FR | 2691738 | A1 | * | 12/1993 | ..... E04G 21/142 |
| FR | 2948139 | A1 | * | 1/2011 | |
| FR | 2948139 | A1 | | 1/2011 | |

OTHER PUBLICATIONS

Machine translation of FR2948139A1, https://worldwide.espacenet.com/patent/search; Mar. 6, 2023 (Year: 2023).*
Machine translation of EP3309327A1, https://worldwide.espacenet.com/patent/search; Mar. 6, 2023 (Year: 2023).*
International Preliminary Report on Patentability dated Apr. 28, 2021 re: Application No. PCT/EP2020/052001, pp. 1-5, citing: FR 2948139 A1 and DE 202014103774 U1.
International Search Report dated May 8, 2020 re: Application No. PCT/EP2020/052001, pp. 1-2, citing: FR 2948139 A1, DE 202014103774 U1, DE 202011000293 U1, EP 3309327 A1.

* cited by examiner

TRANSPORT ANCHOR HAVING A FIBRE-PLASTIC COMPOSITE MATERIAL PRESSURE ELEMENT

TECHNICAL FIELD

The present disclosure relates to a transport anchor for double- and sandwich walls, comprising

- an arc-shaped base body with
  - an arcuate central portion for suspending slinging means,
  - two anchor legs that emanate from the central portion and extend essentially parallel to each other,
- a pressure element arranged between the anchor legs.

The disclosure further relates to a method for manufacturing such a transport anchor.

BACKGROUND

Such transport and laying anchors are used for transporting so-called double- and sandwich walls. They are usually poured into concrete walls in the precast concrete industry, and serve on the one hand as a transport device on which slinging means can be suspended, but on the other hand also as spacers during the concreting process. Sandwich or sandwich concrete walls have insulation between the walls comprised of concrete. To simplify the terms, double wall will be used below as a synonym for double walls and sandwich walls.

Large forces act on the transport anchor during the transport process. In order to prevent the anchor legs from moving toward each other and in the worse case scenario detaching from the walls, the pressure element is arranged between the latter to absorb forces.

Known from publication DE 100 38 249 B4, for example, is a transport anchor in which the pressure element is comprised of steel, and welded onto the anchor legs. During transport of the double walls, the mentioned large forces act on this weakened area, resulting in an extremely high danger that the welded seams will tear, and hence the transport anchor will subsequently undergo excessive deformation. A similar pressure element made of steel may be gleaned from publication EP 3 029 220 A1. In the latter, the pressure element is preferably inserted via point welding. The welding process also locally changes and weakens the surrounding material, which likewise reduces the stability. In both cases, the welded joints can lead to the transport anchor breaking out of the concrete, which in turn can cause the precast concrete part to collapse.

DE 20 2014 103 774 U1 describes a transport anchor in which the pressure element made of steel is shiftably held on the base body. The pressure element is basically supposed to remain in its position due to the diameter of passage openings if not exposed to larger forces from outside: However, this can certainly not be guaranteed. In this regard, the pressure element can also shift during installation, which leads to corresponding disadvantages.

For this reason, transport anchors are known that use a flexible material, for example wood, instead of a pressure element made of steel. While wood is able to absorb the arising forces, the disadvantage is that wood can absorb liquid, which on the one hand results in a rotting of the pressure element, but on the other hand can also freeze and expand. Both are disadvantageous, since damage can still also arise in the double wall or precast concrete part afterwards.

For example, DE 10 2005 009708 A1 describes a variant in which the pressure element can be made out of textile concrete. However, it is also essential in this variant that the pressure element yield to lateral pressure. In this regard, a detachment from the double wall is also possible in this variant.

All of the transport anchors described in prior art are relatively complicated and cost-intensive to manufacture. Also problematical are the arising cold bridges, weathering or rusting, and the comparatively high dead weight.

SUMMARY

The disclosure creates a transport anchor that does not have the disadvantages mentioned above. Nevertheless, the transport anchor is still to be cost-effective to manufacture, and enable a safe use. Furthermore, the transport anchor is not to lead to damages or disadvantages even if it later remains in the double wall. The disclosure further proposes a method for manufacturing such a transport anchor.

The disclosure is achieved by providing the pressure element comprising a fiber-plastic composite material, and at both of its ends has end caps, which with an open side are each placed onto a free end of the cylindrical pressure element, and each have openings through which a respective anchor leg extends.

The use of a fiber-plastic composite material is not known from prior art. The use of such a material for transport anchors is regarded as disadvantageous, in particular with respect to the forces to be absorbed. However, tests have shown that the disadvantages to be expected in conjunction with concrete walls, in particular with sandwich concrete walls, are evidently eliminated. The transport anchors according to the disclosure are certainly capable of safely absorbing all necessary forces.

In addition, the pressure element according to the disclosure comprised of fiber-plastic composite material is advantageously watertight, thereby preventing moisture from moving from one double wall to another by way of the pressure element. This is not the case in particular for pressure elements made of wood and tubular pressure elements made of steel that are hollow inside.

In another, independent aspect of the instruction, the disclosure also provides the pressure element comprised of steel, and at both of its ends has end caps, which with an open side are each placed onto a free end of the cylindrical pressure element, and each have openings through which a respective anchor leg extends. With regard to the transport anchor as a whole, the pressure element made out of steel instead of fiber-plastic composite material according to this aspect of the instruction has the same advantages with respect to the pressure element with the anchor legs, since the pressure element made out of steel instead of fiber-plastic composite material in this embodiment can be attached to the anchor legs with end caps identically designed in the embodiment described above. As a consequence, the following advantages of a transport anchor with a pressure element made out of fiber-plastic composite material can also be transferred to this embodiment of a transport anchor with a pressure element made out of steel, provided the advantages are not explicitly to be attributed to the fiber-plastic composite material.

The pressure element can basically have any cross section desired, with round, oval, rectangular or triangular cross sections being suitable in particular. The free end faces of the pressure element can have a groove per anchor leg, in which the axis leg held by the end caps fits tightly. This further increases the stability.

One significant advantage to fiber-plastic composite material further lies in the fact that no cold bridges can arise. It has a comparatively low mass, does not rust, and as opposed to concrete is very robust, with any flaking or breaking off of material being nearly precluded. The mechanical and thermal properties of fiber-plastic composite material can be adjusted via a plurality of parameters. Aside from the fiber-matrix combination, for example, the fiber angle, fiber volume percentage, layer sequence and much more can be varied. For example, organic, inorganic or even natural fibers can be used. The length of the used fibers can also be varied.

The transport anchor according to the disclosure can be manufactured especially easily and quickly in particular by using the advantageous end caps. According to the disclosure, the end caps are designed as pipe sections that have two openings lying one opposite the other. Alternatively, the end caps can also be cup-shaped in design, and then have a floor surface adjoined by a peripheral surface. The cup opening is arranged opposite the floor surface. Two openings lying opposite each other are provided in the end caps or in the peripheral surface of the end caps, through which a respective anchor leg extends in the assembled end state. The end caps are preferably made out of a resistant plastic.

When assembling the transport anchor, the end caps are placed onto the pressure element comprised of fiber-plastic composite material on the end side over one of their openings. The anchor legs are each passed through the openings of the end caps, and the pressure element is pushed to the desired position. The inner diameters of the end caps are here designed somewhat smaller than the end-side outer diameter of the pressure element. If the elements to be assembled are each in the correct position, they are mechanically pressed together, meaning that the end caps are pushed onto the free ends of the pressure element. The elasticity of the end caps is sufficient to allow the latter to widen adequately. As a consequence, the anchor legs are likewise fixedly held in the end caps. The local change in the welding area and breaking of welded joints usually caused by welding pressure elements with the anchor legs is precluded.

Alternatively, it is possible to initially press the end caps, and only then introduce the anchor legs through the openings. This presupposes that the openings remain free during the pressing process.

The pressure element can be arranged in the area of the transport anchor by having the anchor legs run essentially parallel to each other. However, the pressure element can preferably also be arranged in a transitional area between the arcuate central position and the anchor legs that extend parallel to each other. Finally, an arrangement within the arcuate central portion is also conceivable.

The central portion can be comprised of two straight leg sections that run toward each other, which are connected with each other by a relatively short arc. As a consequence, the central portion as a whole has roughly a triangular shape. Alternatively, the arcuate base body can also be curved over its entire length proceeding from the transitional area.

The anchor legs can be straight in design over their entire length, but can alternatively also have free end areas that are formed out of the otherwise straight extension of the anchor legs. The reshaping can here take place in all directions, for example toward each other, away from each other, or parallel to each other, or in varying directions.

The base body is usually comprised of a solid steel or a single steel strand. In an especially advantageous embodiment variant, the latter can also comprise a wire or wire rope. While a stainless steel rope or cable is preferably suitable, for example a galvanized steel cable, it is also conceivable to use a sufficiently tension-resistant rope, for example made of Kevlar or carbon. The use of a cable or rope makes manufacturing easier and faster due to the flexibility. Because a wire or steel rope comprises a plurality of strands or wires, the transport anchor according to the disclosure is safer to use. All strands usually do not tear at the same time, but rather individually, so that time often still remains to put down the double walls before the rope tears completely.

It has further been shown that, when wire ropes are used as the base body, the latter can be delivered in the wound state. The free sections of the axis legs of the manufactured transport anchor that extend roughly parallel can be rolled up and fixed in the rolled-up position with the help of fastening means. The overall length of the transport anchor is reduced as a result, so that smaller packing dimensions can be achieved. This significantly reduces the transport costs and transport complexity. The use of retaining clips made of plastic has proven especially suitable for fixing the rolled up axis legs in place. Alternatively, however, the retaining clips can also be made out of another material, for example wire or steel. Finally, they must be able to secure the rolled up axis legs against unwinding.

The openings for poking through the base body or anchor leg can preferably run slanted or be arranged offset to each other, so that the anchor legs are guided through the pressure element at an angle, and do not run parallel to each other. The distance between the two anchor legs increases in the direction of their free ends. This is advantageous in particular when the base body comprises a flexible steel rope. In this case, the arcuate central portion deforms above the pressure element while lifting the component to be transported. The arcuate central portion is stretched. Under a load, the anchor legs thus run straight through the pressure element owing to the slanted openings.

According to the disclosure, it can further be provided that the pressure element be fixedly, i.e., immovably, connected with the base body, or it can also be provided that the latter be shiftable along the anchor legs. The varying connection can be determined by the manufacturing process according to the disclosure through the selection of the pressure, with which the end caps are pressed onto the pressure element in an axial direction, i.e., with which they clamp in the axis legs.

The base body of a transport anchor according to the disclosure can preferably be shortened by virtue of the free ends having cross sectional reinforcements, for example in the form of tubular sections or cylindrical bodies. This improves the connection between the base body or anchor leg and the respective double wall. The cross sectional reinforcements can also be fabricated out of another material.

In order to prevent the anchor legs from floating during installation into the double wall, a fixedly connected or demountable fixing element can additionally be advantageously provided, which runs roughly parallel to the pressure element between the axis legs. The latter can likewise comprise steel, but also of plastic or some other suitable material.

Alternatively, however, it can also be advantageous for the free ends of the anchor legs to taper. This makes it easier to introduce the anchors into the double walls, in particular if they have a steel reinforcement.

BRIEF DESCRIPTION OF THE DRAWINGS

The disclosure will be explained in more detail based on the following figures. These show various embodiments of a transport anchor according to the disclosure, wherein additional forms are conceivable. Shown on.

DETAILED DESCRIPTION OF THE DRAWINGS

Figure 1:
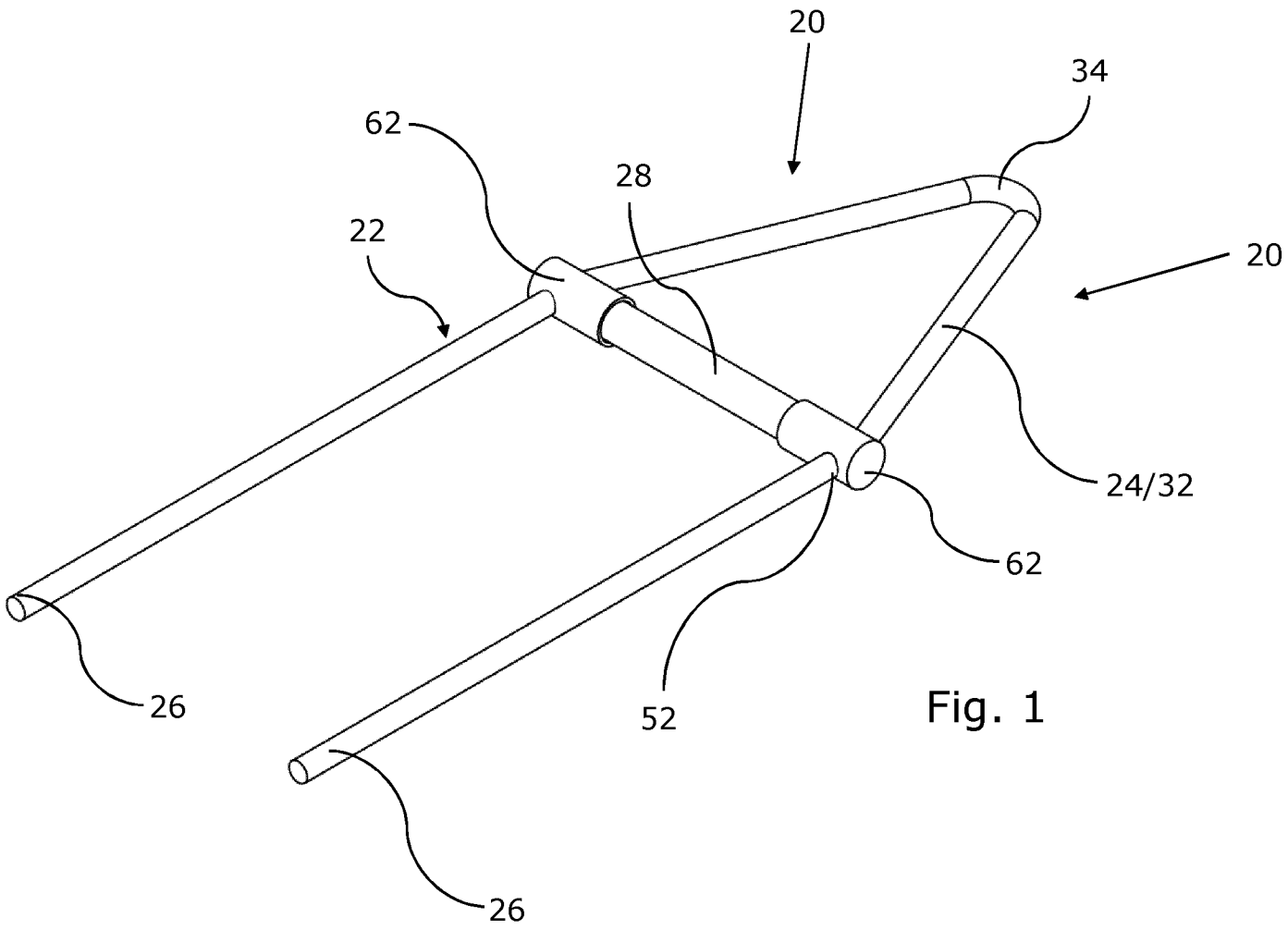
FIG. 1: is a perspective view of a first embodiment variant of a transport anchor according to the disclosure with a base body made out of steel.

FIGS. 1 to 6 show different variants of a transport anchor 20. The depicted figures or embodiments serve an explanatory purpose; individual features of the individual exemplary embodiments can be combined with features of other exemplary embodiments as desired.

The transport anchor 20 has a base body 22 with an arcuate central portion 24 and adjoining anchor legs 26 that run parallel to each other. Further shown is a pressure element 28 arranged between the anchor legs 26.

According to the disclosure, the base body preferably comprises steel, a steel rope or a rope made out of another resistant, suitable material. The pressure element 28 is comprised of a fiber-plastic composite material.

Figure 2:
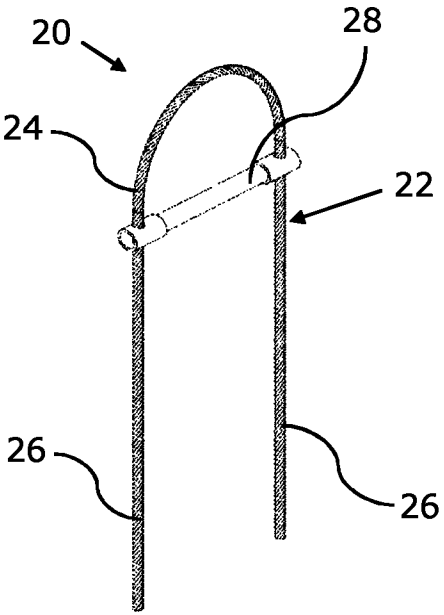
FIG. 2: are two perspective views of a second embodiment variant of a transport anchor according to the disclosure with a base body made out of a steel rope.
Figure 2:
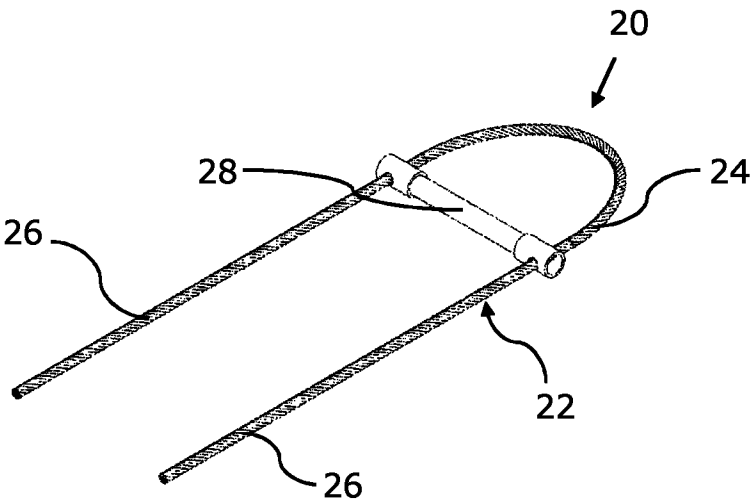

According to the disclosure, the pressure element 28 can be arranged at various locations in the progression of the base body. FIGS. 1 and 2 exemplarily show a possible position, specifically adjacent to a transitional area between the anchor legs 26 and the arcuate central portion 24. Alternatively, the pressure element 28 can be arranged in the transitional area, with a larger distance to the transitional area, or also within the arcuate central section 24.

The arcuate central portion 24 can have an essentially triangular shape, comprised of two straight leg sections 32 that transition into a relatively narrow arc 34. For example, this is the case for a base body 22 made out of steel or steel wire (FIG. 1). Alternatively thereto, the arcuate central portion 24 can also be arc-shaped in design as a whole, in particular when using a steel rope (FIG. 2).

The free ends of the pressure element 28 are adjoined by the end caps 62 with openings holes 52 for poking through the anchor legs 26 on the end side. In the depicted exemplary embodiment, the end caps 62 are essentially tubular in design, and one of their open sides is plugged onto the ends of the pressure element 28. Because the inner diameters of the end caps 62 are smaller than the outer diameters of the pressure element 28, the end caps 62 have to be pushed or pressed onto the pressure element 28. They widen as a result, and are fixedly and immovably retained on the pressure element 28 after assembly owing to their elasticity.

In the exemplary embodiment shown, the openings 52 through which the anchor legs 26 extend are arranged precisely opposite each other, so that the anchor legs 26 run parallel to each other and essentially at a right angle to the main extension of the pressure element 28. Alternatively, however, the openings 52 can also be arranged slanted or offset to each other, so that the anchor legs 26 are guided through the end caps 62 at an angle, and do not run parallel to each other further on.

Figure 3:
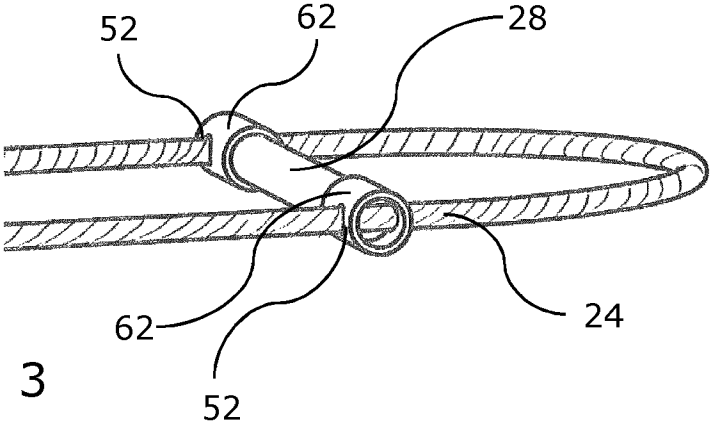
FIG. 3: is a magnified view of an end cap with introduced steel rope.

FIG. 3 shows a magnified view of an end cap 62 with a steel rope introduced through the openings 52. The advantage to designing the end caps 62 as a tubular section is that liquid concrete can penetrate from outside into the component to be transported through the opened free end of the end cap 62 while casting the transport anchor, which improves the subsequent stability and tensile strength of the overall construction. The pressure element 28 can have a respective groove at its two free end faces, in which the legs come to lie.

Figure 4:
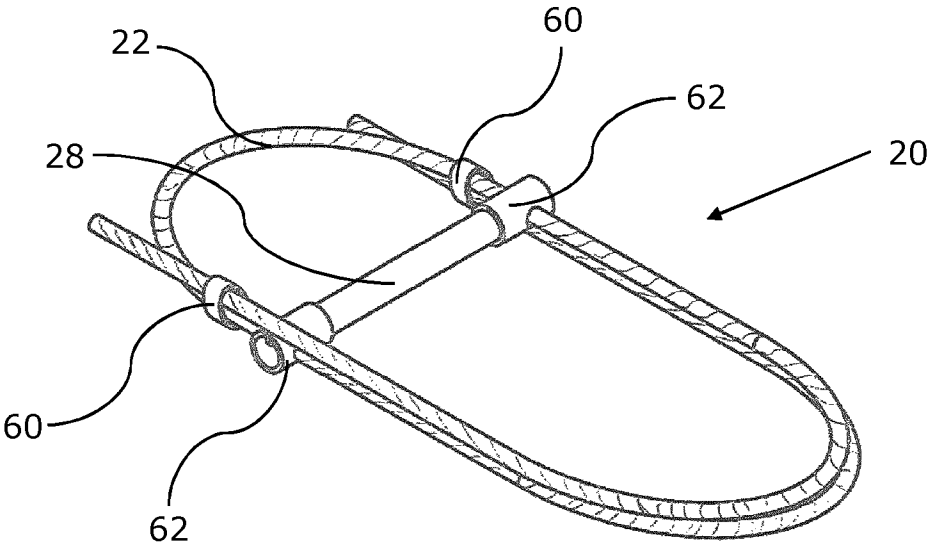
FIG. 4: is a top view of the transport anchor on FIG. 2 in transport state 3.

FIG. 4 shows the transport anchor on FIG. 2 in a transport state. As evident, using the steel rope advantageously makes it possible to roll up the latter and temporarily fix it in place for transport or packaging with the help of fastening means 60. Shown are retaining clips that can be pressed onto the steel rope. Alternatively, however, fastening means 60 can also be made out of a different material, for example out of wire or steel.

Figure 5:
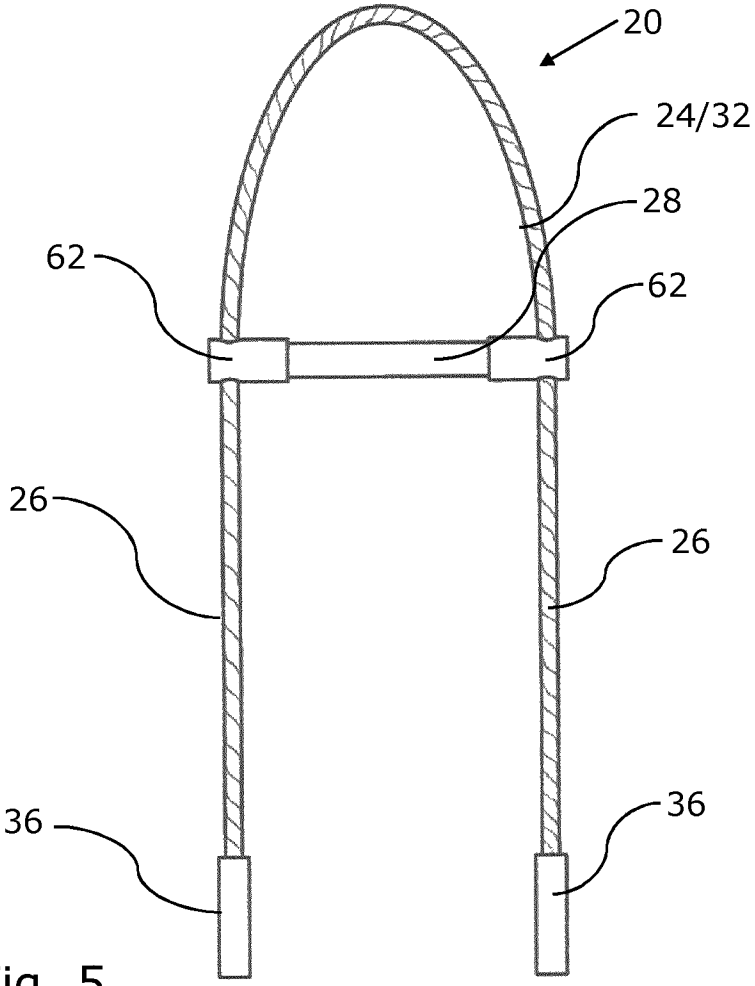
FIG. 5: is a transport anchor according to the disclosure with cross sectional reinforcements.

On the one hand, the anchor legs 26 can be conical or tapered in design at their free ends; however, their free ends can also be provided with cross sectional reinforcements 36 (see FIG. 5). The cross sectional reinforcements 36 can comprise the same material as the base body 22, but can also be made out other materials. Shown is the use of a base body 22 comprising a steel rope; of course, the cross sectional reinforcements 36 can also be combined with a base body comprised of steel or steel wire.

Figure 6:
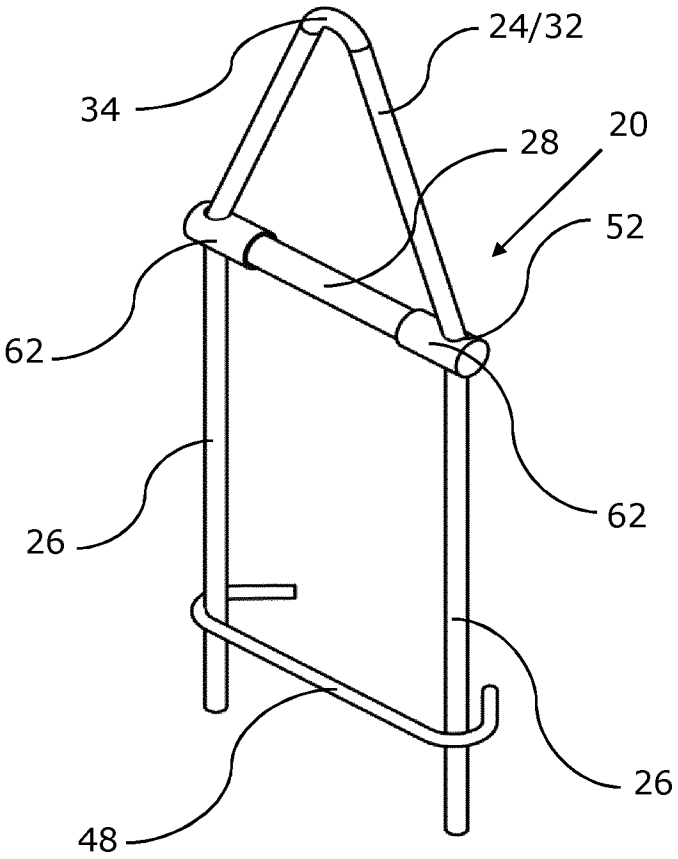
FIG. 6: is a perspective view of a transport anchor according to the disclosure with a fixing element.

FIG. 6 shows a fixing element 48 that runs essentially parallel to the pressure element 28, and holds the two anchor legs 26 in their position or pretensioned relative to each other. Fixing elements 48 make sense in particular when using a base body 22 comprised of steel or steel wire. Connecting, preferably welding, the fixing element 48 with the two anchor legs 26 makes it possible to additionally reduce the overall length of the anchor legs 16.

The embodiment variants depicted on FIGS. 1 to 6 with the pressure element 28 comprised of a fiber-plastic composite material can alternatively also be modified so as to have the pressure element 28 comprises steel. The depicted advantages can also be applied to such an embodiment variant.

The end caps 62 are especially advantageously made out of a plastic. This makes it especially easy to press the pressure element 28, anchor leg 26 and end cap 62 elements with each other.

The figures show various advantageous embodiment variants of the disclosure. The shown combinations are not to be regarded as conclusive; rather, they can be combined with each other in any manner desired.

The invention claimed is:

1. A transport anchor for double- and sandwich walls, comprising:

an arc-shaped base body with an arcuate central portion for suspending slinging means, two anchor legs that emanate from the central portion and extend essentially parallel to each other, and a pressure element arranged between the anchor legs, wherein the pressure element comprises a fiber-plastic composite material, the pressure element is cylindrical and, at both ends, has end caps being cup-shaped or tubular, which end caps are each placed with an open side onto a free end of the pressure element, wherein two holes lying opposite each other are provided in a cup-shaped or tubular peripheral surface of the end caps, through which a respective anchor leg extends in the assembled state.

2. The transport anchor according to claim 1, wherein a maximum inner diameter of the end caps is smaller than a maximum outer diameter of the free ends of the pressure element, so that the end caps are frictionally held on the pressure element.

3. The transport anchor according to claim 1, wherein the holes are arranged diametrically opposite each other, so that the anchor legs are guided through at a right angle to the extension of the pressure element.

4. The transport anchor according to claim 1, wherein the arc-shaped base body is comprised of a steel rope.

5. The transport anchor according to claim 1, wherein the arc-shaped base body is comprised of steel.

6. The transport anchor according to claim 1, wherein the pressure element is arranged in the progression of the anchor legs extending parallel to each other.

7. The transport anchor according to claim 1, wherein a fixing element is provided, which essentially runs parallel to the pressure element and fixes the anchor legs in their position.

8. The transport anchor according to claim 1, wherein the free ends of the anchor legs have reinforcements.

9. A transport anchor for double- and sandwich walls, comprising:

an arc-shaped base body with an arcuate central portion for suspending slinging means, two anchor legs that emanate from the central portion and extend essentially parallel to each other, and a pressure element arranged between the anchor legs, wherein the pressure element comprises steel, the pressure element is cylindrical and, at both of its ends, has end caps being cup-shaped or tubular, which end caps are each placed with an open side onto a free end of the pressure element, wherein two holes lying opposite each other are provided in a cup-shaped or tubular peripheral surface of the end caps, through which a respective anchor leg extends in the assembled state.

10. A method for manufacturing a transport anchor with the features in claim 1, further including the following procedural steps:

manufacturing an arc-shaped base body with an arcuate central portion and two anchor legs that emanate from the central portion and extend essentially parallel to each other, manufacturing an oblong pressure element out of fiber-plastic composite material or steel, manufacturing end caps with a cross section that corresponds to the free ends of the pressure element, wherein the maximum inner diameter of the end caps is smaller than the maximum outer diameter of the free ends of the pressure element, and the end caps further each have holes for passing through anchor legs, arranging the end caps on the pressure element, guiding the anchor legs through the holes and positioning the pressure element at the final position, and pressing the pressure element, anchor leg and end cap elements with each other.

* * * * *